US011039721B2

(12) United States Patent
Tahara et al.

(10) Patent No.: US 11,039,721 B2
(45) Date of Patent: Jun. 22, 2021

(54) CYCLONE UNIT

(71) Applicant: MAKITA CORPORATION, Anjo (JP)

(72) Inventors: Takayuki Tahara, Anjo (JP); Akane Akisada, Anjo (JP)

(73) Assignee: MAKITA CORPORATION, Anjo (JP)

( * ) Notice: Subject to any disclaimer, the term of this patent is extended or adjusted under 35 U.S.C. 154(b) by 439 days.

(21) Appl. No.: 16/144,236

(22) Filed: Sep. 27, 2018

(65) Prior Publication Data

US 2019/0167055 A1 Jun. 6, 2019

(30) Foreign Application Priority Data

Dec. 1, 2017 (JP) ..... JP2017-231855

(51) Int. Cl.

| | |
|---|---|
| ***A47L 9/16*** | (2006.01) |
| ***A47L 9/24*** | (2006.01) |
| ***A47L 5/24*** | (2006.01) |
| ***A47L 5/36*** | (2006.01) |
| ***A47L 9/10*** | (2006.01) |

(52) U.S. Cl.

CPC ..... *A47L 9/1608* (2013.01); *A47L 5/24* (2013.01); *A47L 5/362* (2013.01); *A47L 9/104* (2013.01); *A47L 9/165* (2013.01); *A47L 9/1666* (2013.01); *A47L 9/1683* (2013.01); *A47L 9/1691* (2013.01); *A47L 9/248* (2013.01)

(58) Field of Classification Search

CPC ..... A47L 9/1608; A47L 9/165; A47L 5/24; A47L 5/362; A47L 9/104; A47L 9/1666; A47L 9/1683; A47L 9/1691; A47L 9/248

See application file for complete search history.

(56) References Cited

U.S. PATENT DOCUMENTS

| | | | | |
|---|---|---|---|---|
| 6,195,835 | B1 | 3/2001 | Song et al. | |
| 2003/0015239 | A1 | 1/2003 | Brink et al. | |
| 2011/0219733 | A1* | 9/2011 | Greene | B01D 45/12 55/337 |

FOREIGN PATENT DOCUMENTS

| | | | |
|---|---|---|---|
| JP | S51-55474 | U | 4/1976 |
| JP | 56-021458 | Y | 5/1981 |
| JP | H8-128366 | A | 5/1996 |
| JP | 3102864 | B2 | 10/2000 |
| JP | 2003-250734 | A | 9/2003 |

(Continued)

OTHER PUBLICATIONS

Oct. 2, 2020 Office Action issued in Japanese Patent Application No. 2017-231855.

(Continued)

*Primary Examiner* — Andrew A Horton
(74) *Attorney, Agent, or Firm* — Oliff PLC

(57) ABSTRACT

A cyclone unit capable of enhancing dust collection performance. A cyclone unit includes a cyclone unit body, a dust box and a core tube. The cyclone unit body includes a lower base, an upper base and a middle base sandwiched between the lower base and the upper base. The dust box is assembled to the cyclone unit body so as to collect dust and dirt. The core tube, having a meshed shape, is assembled to the middle base so as to be located inside the dust box. The core tube is detachable from the middle base while the upper base is assembled to the lower base.

9 Claims, 13 Drawing Sheets

(56) References Cited

FOREIGN PATENT DOCUMENTS

JP 2006-061897 A 3/2006

OTHER PUBLICATIONS

Feb. 16, 2021 Notice of Submission of Publications issued in Japanese Patent Application No. 2017-231855.
Feb. 5, 2021 Submission of Publication issued in Japanese Patent Application No. 2017-231855.

* cited by examiner

CYCLONE UNIT

CROSS-REFERENCE TO RELATED APPLICATIONS

This application claims the benefit of priority to Japanese Patent Application No. 2017-231855, filed on Dec. 1, 2017, the entire contents of which are hereby incorporated by reference.

BACKGROUND

1. Technical Field

The present invention relates to a cyclone unit.

2. Description of the Background

A cleaner 101 is of a conventionally known type and is capable of executing dust collection by a cyclone unit 102 (i.e., pre-dust collection) even before dust collection by a cleaner body 110 thereof (i.e., pre-process) in order to inhibit degradation in suction force of the cleaner body 110 (see FIG. 13). The cyclone unit 102 includes a cyclone unit body 140 and a dust box 190. The cyclone unit body 140 separates dust and dirt from air sucked through a suction tool (nozzle head) 120 by cyclone action. The dust box 190 is assembled to the cyclone unit body 140 and collects the separated dust and dirt. The cyclone unit body 140, disclosed in Japanese Patent No. 3102864 (hereinafter referred to as "Patent Literature 1"), includes a lower base 142, an upper base 160 and a middle base 170 (see FIGS. 14 and 15). The lower base 142 is coupled to the suction tool 120 side. The upper base 160 is assembled to the lower base 142, and is coupled to the cleaner body 110 side. The middle base 170 is sandwiched between the lower base 142 and the upper base 160. A core tube 180 having a meshed shape is mounted to the middle base 170 so as to be located inside the dust box 190. With this configuration, the cyclone unit 102 can collect even lightweight dust and dirt (e.g., hair) that are inseparable by the cyclone action, and can be enhanced in dust collection performance.

BRIEF SUMMARY

In the art of Patent Literature 1, the core tube 180 is detached from the cyclone unit body 140 in order to enhance workability in maintenance of removing dust and dirt collected by the core tube 180. At this time, it is bothersome to perform detachment of the middle base 170 sandwiched between the lower base 142 and the upper base 160.

It is an object of the present invention to enhance workability in maintenance of a cyclone unit capable of enhancing dust collection performance.

A first aspect of the present embodiment is to provide a cyclone unit including:

a cyclone unit body including a lower base, an upper base assembled to the lower base, and a middle base sandwiched between the lower base and the upper base;

a dust box assembled to the cyclone unit body so as to collect dust and dirt; and a core tube having a meshed shape, the core tube being assembled to the middle base so as to be located inside the dust box, the core tube being detachable from the middle base while the upper base is assembled to the lower base.

A second aspect of the present embodiment is to provide a cyclone unit including:

a cyclone unit body;

a dust box assembled to the cyclone unit body so as to collect dust and dirt; and a core tube having a meshed shape, the core tube being assembled to the cyclone unit body so as to be located inside the dust box, the core tube being detachable from the cyclone unit body.

DETAILED DESCRIPTION

An embodiment of the present invention will be hereinafter explained with FIGS. 1 to 12. It should be noted that in the following explanation, "a handy cleaner 1" will be explained as an example of "a cleaner". Additionally in the following explanation, the terms "up", "down", "front", "rear", "right" and "left" indicate up, down, front, rear, right and left directions described in the aforementioned FIGS. 1 and 2, in other words, up, down, front, rear, right and left directions defined with reference to the handy cleaner 1. First of all, the handy cleaner 1 and a cyclone unit 2 attachable to the handy cleaner 1 will be separately explained.

Figure 1:
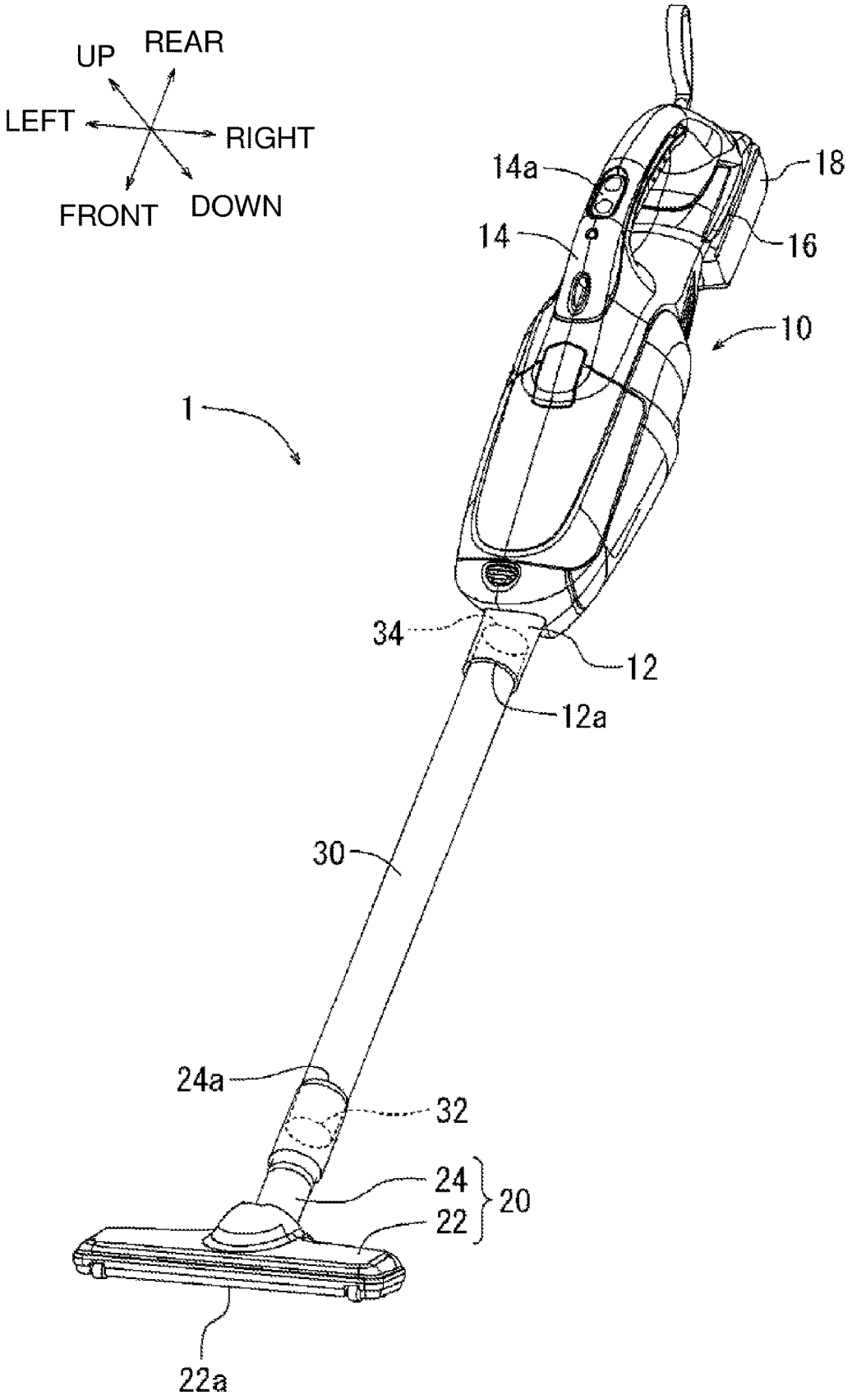
FIG. 1 is a perspective view of a handy cleaner according to an embodiment.

First, the handy cleaner 1 will be explained with reference to FIG. 1. The handy cleaner 1 includes a cleaner body 10, a nozzle head 20 and an extension pipe (coupling tube) 30. The cleaner body 10 generates a suction force by rotation of a suction fan (not shown in the drawings) for which an electric motor (not shown in the drawings) functions as a drive source. The nozzle head 20 sucks air by the suction force from the cleaner body 10. The extension pipe 30 couples the cleaner body 10 and the nozzle head 20 therethrough.

The cleaner body 10 includes a dust collection compartment (not shown in the drawings) including a filter (not shown in the drawings) in a front-side part of the interior thereof. Additionally, the cleaner body 10 includes the aforementioned electric motor and suction fan in a rear-side part of the interior thereof. The cleaner body 10 includes a connection nozzle 12 on the front side thereof. A rear end 34 of the extension pipe 30 is inserted into a front end 12*a* of the connection nozzle 12.

The cleaner body 10 includes a handle 14 having a looped shape on the upper side thereof. The handle 14 includes a switch 14*a* capable of turning on and off the electric motor. When a turn-on operation is performed by the switch 14*a*, the electric motor is driven whereby the suction fan is rotated. Accordingly, air A is sucked through the connection nozzle 12, and then, dust and dirt D contained in the sucked air A can be collected (trapped) by the filter in the dust collection compartment. When a turn-off operation is performed for the switch 14*a*, the electric motor is stopped whereby rotation of the suction fan is also stopped. Accordingly, suction of the air A through the connection nozzle 12 is stopped as well.

The cleaner body 10 includes a battery attachment part 16 on the rear side thereof. A rechargeable battery 18, functioning as a power source of the electric motor, is attached to the battery attachment part 16. The battery 18 is slidable in the back-and-forth direction with respect to the battery attachment part 16. When slid in an approaching direction to the cleaner body 10 with respect to the battery attachment part 16, the battery 18 is locked to the battery attachment part 16.

Accordingly, the battery 18 is attached to the battery attachment part 16. On the other hand, when an unlock button (not shown in the drawings) is operated to release locking, the battery 18 is released from the locked state. Then, when slid in a separating direction from the cleaner body 10 with respect to the battery attachment part 16, the battery 18 is made detachable from the battery attachment part 16.

The nozzle head 20 includes a head housing 22 and a connection pipe 24. The head housing 22 includes a suction port 22*a* through which air can be sucked. The connection pipe 24 is coupled to the head housing 22 through a ball joint mechanism (not shown in the drawings). Because of this, the head housing 22 is pivotable up and down and right and left with respect to the connection pipe 24. A front end 32 of the extension pipe 30 is inserted into a rear end 24*a* of the connection pipe 24.

In the handy cleaner 1, the suction port 22*a* of the head housing 22, the connection pipe 24, the extension pipe 30 and the connection nozzle 12 are communicated with each other. Therefore, when the electric motor is driven whereby the suction fan is rotated, the air A is sucked through the suction port 22*a* of the head housing 22, and then, the dust and dirt D contained in the sucked air A can be collected by the filter in the dust collection compartment. When the turn-off operation is performed for the switch 14*a*, the electric motor is stopped whereby rotation of the suction fan is also stopped. Accordingly, suction of the air A through the suction port 22*a* of the head housing 22 is stopped as well.

Figure 3:
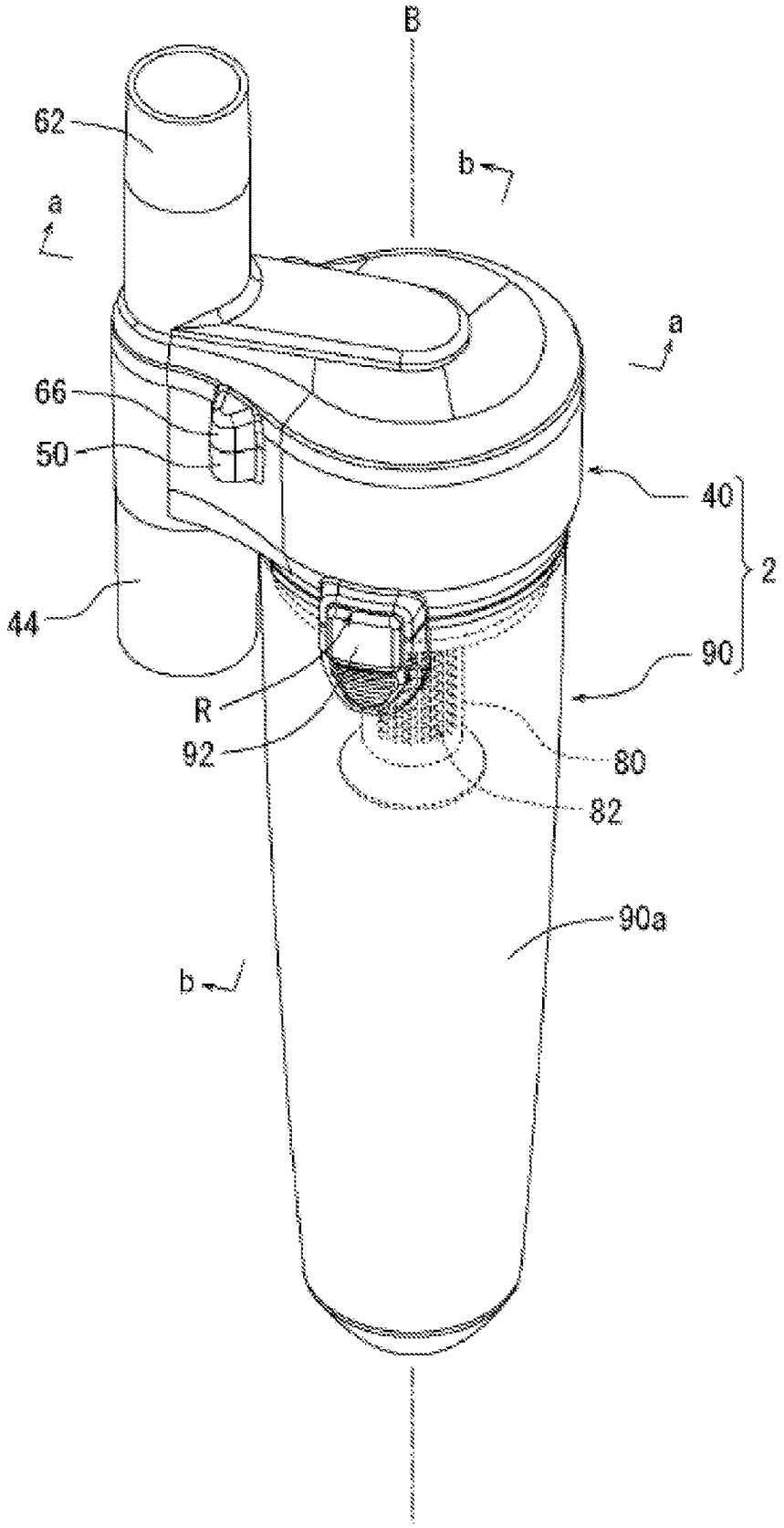
FIG. 3 is an enlarged view of the cyclone unit.

Next, the cyclone unit 2 will be explained with reference to FIGS. 3 to 11. As shown in FIG. 3, the cyclone unit 2 includes a cyclone unit body 40 and a dust box 90. The cyclone unit body 40 separates the dust and dirt D from the air A sucked through the suction port 22*a* of the head housing 22 by cyclone action. The dust box 90 is assembled to the cyclone unit body 40, and collects the separated dust and dirt D.

Figure 4:
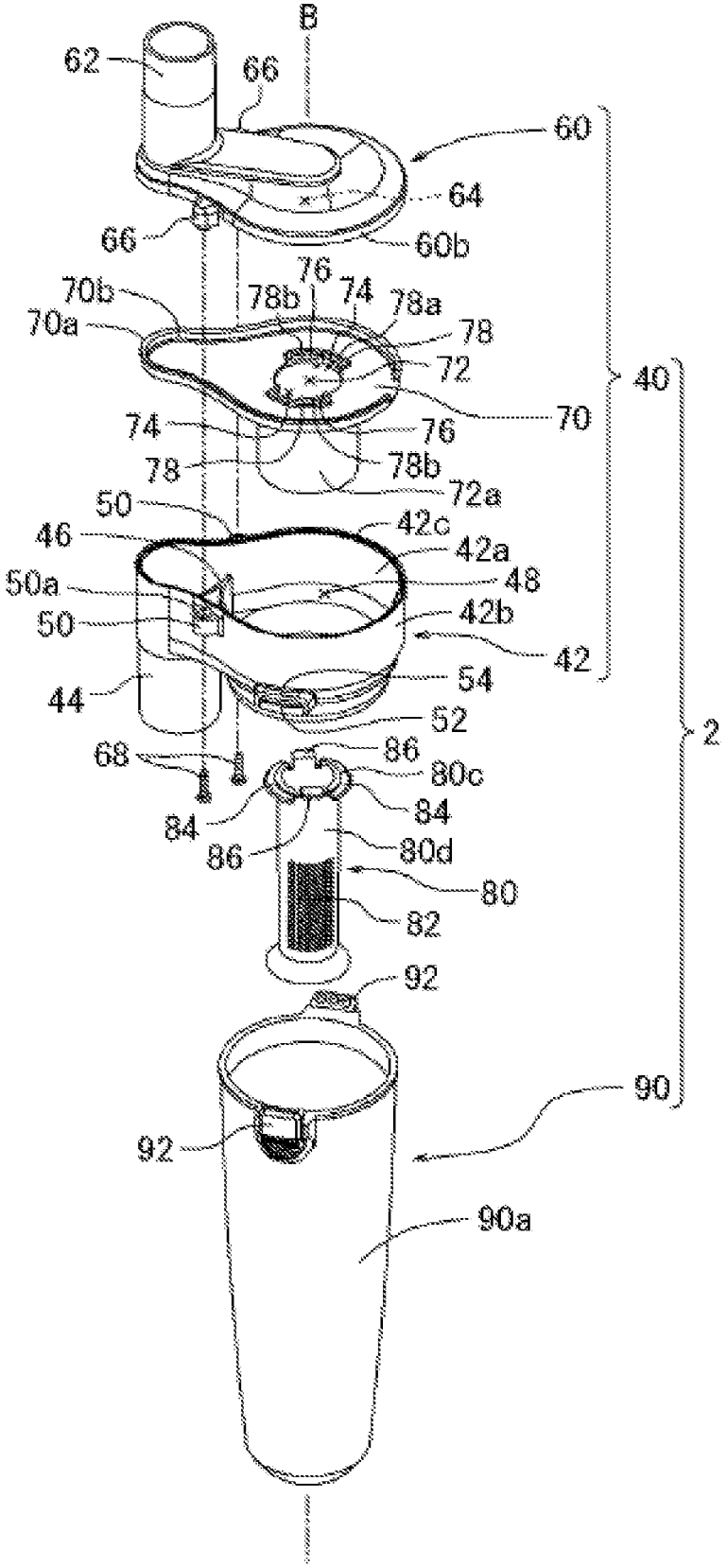
FIG. 4 is an exploded view of the cyclone unit.

As shown in FIG. 4, the cyclone unit body 40 includes a lower base 42, an upper base 60 and a middle base 70. The lower base 42 is coupled to the rear end 34 of the extension pipe 30. The upper base 60 is assembled to the lower base 42, and is coupled to the connection nozzle 12. The middle base 70 is sandwiched between the lower base 42 and the upper base 60.

Figure 5:
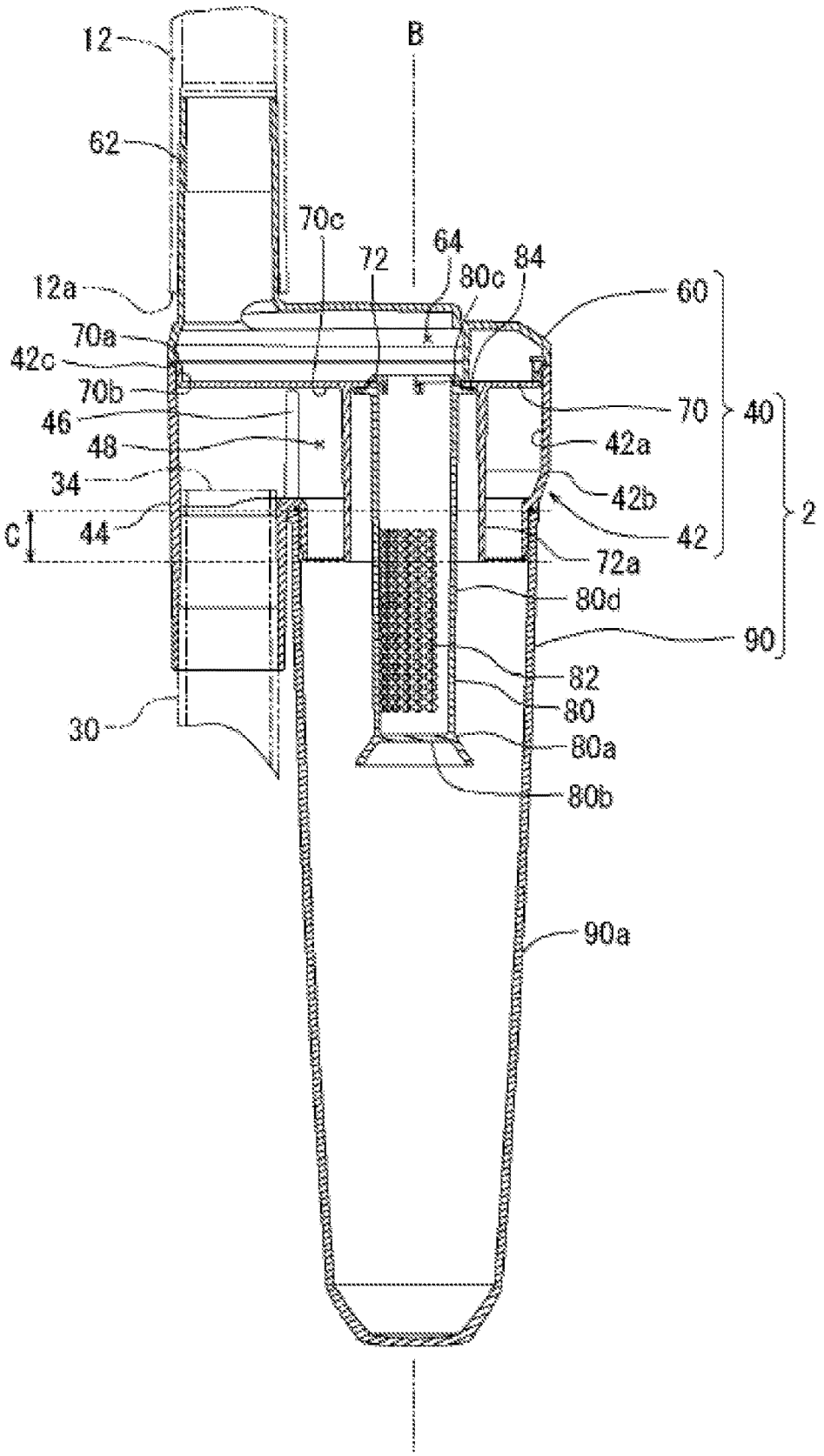
FIG. 5 is a cross-sectional view of FIG. 3 taken along line a-a.

The lower base 42 will be herein explained in detail. As shown in FIGS. 4 and 5, the lower base 42 includes a suction pipe 44 into which the rear end 34 of the extension pipe 30 is insertable. The axis of the suction pipe 44 is eccentric with respect to an axis B of the cyclone unit 2. The lower base 42 includes a rib 46 on an inner surface 42*a* thereof. Additionally, the lower base 42 includes an air inflow part 48 in the interior thereof. The interior of the suction pipe 44 and the air inflow part 48 are communicated with each other.

Figure 6:
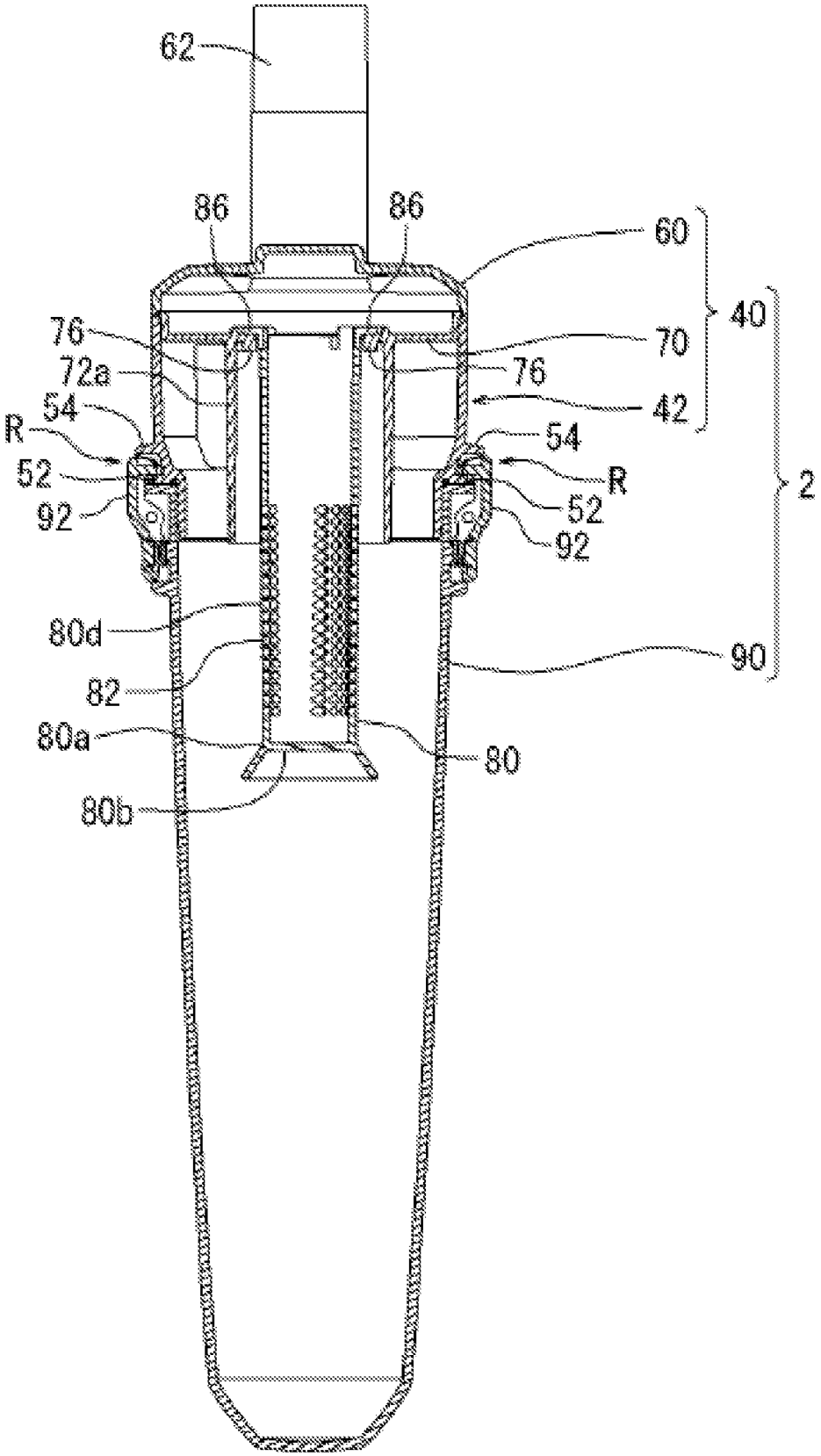
FIG. 6 is a cross-sectional view of FIG. 3 taken along line b-b.
Figure 7:
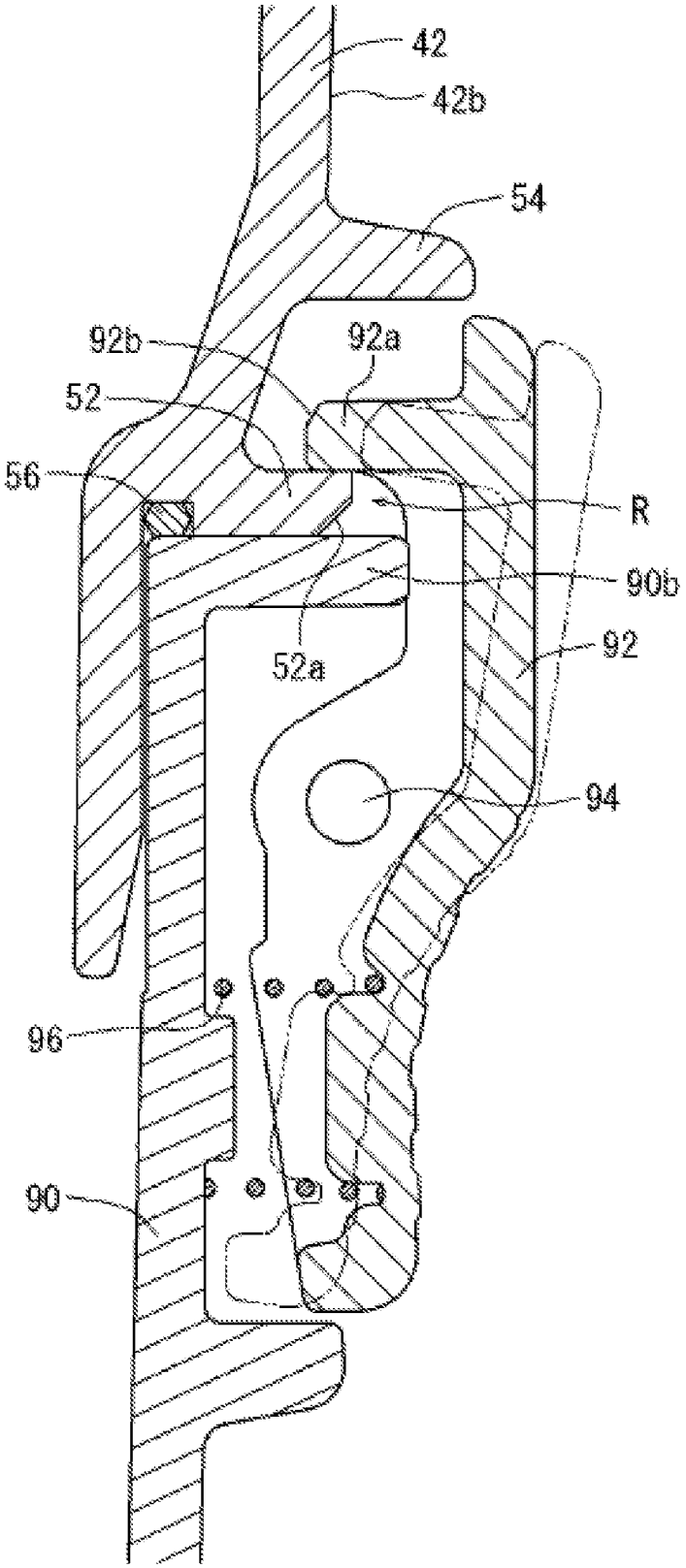
FIG. 7 is an enlarged view of a lock part R shown in FIG. 6.
Figure 8:
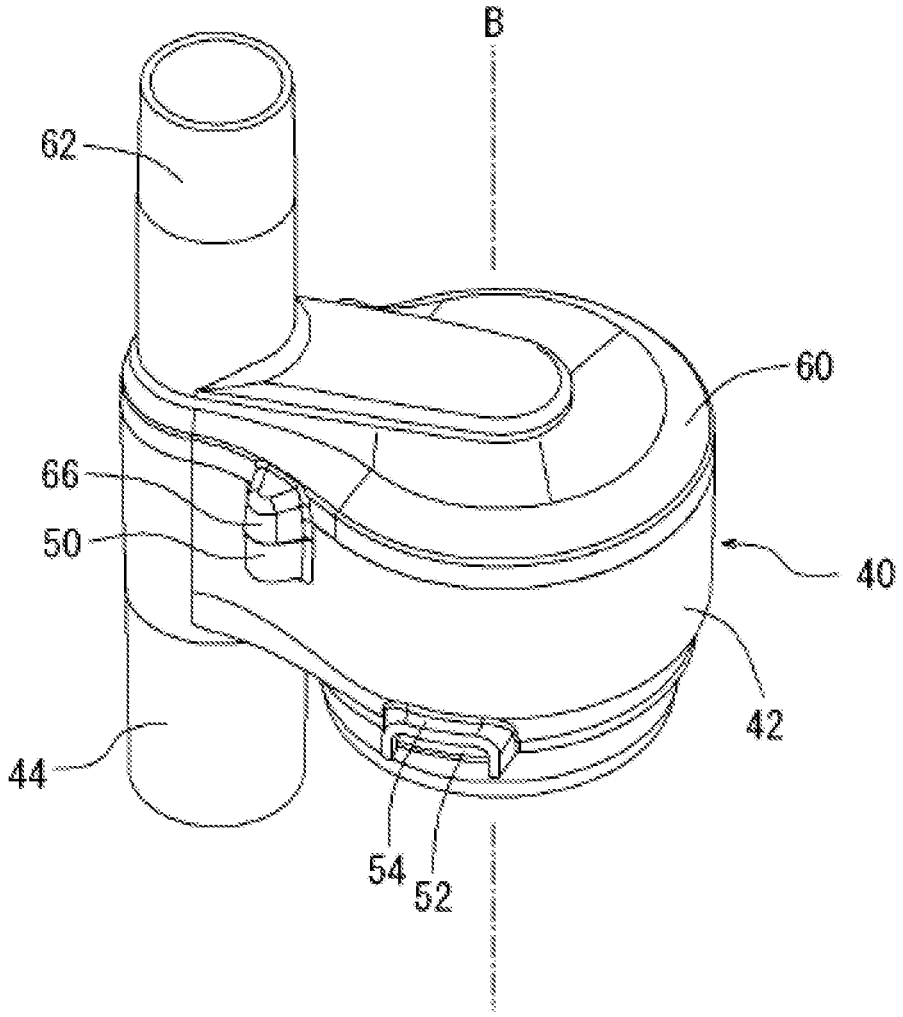
FIG. 8 is a view of a cyclone unit body for which assemblage is ongoing.

The rib 46 causes the air A, sucked through the suction pipe 44, to cause the cyclone action. The lower base 42 includes a pair of bosses 50 on an outer surface 42*b* thereof. Each boss 50 includes a screw hole 50*a* that enables a screw 68 to penetrate therethrough. As shown in FIG. 6, the lower base 42 includes a pair of hooked tabs 52 on the outer surface 42*b* thereof. The pair of hooked tabs 52 enables hooks 92*a* of a pair of engaging pawls 92 of the dust box 90 (to be described) to be hooked thereon. As shown in FIG. 7, each hooked tab 52 includes a slope 52*a* on the tip thereof.

The lower base 42 includes a pair of protection tabs 54 on the outer surface 42*b* thereof. Each protection tab 54 protects each engaging pawl 92, while the hook 92*a* of each engaging pawl 92 is hooked on each hooked tab 52. A packing 56 having a ring shape is assembled to the outer surface 42*b* of the lower base 42. Accordingly, when the dust box 90 is assembled to the cyclone unit body 40 (the lower base 42), sealing performance is enhanced at the assembled site.

Next, the upper base 60 will be explained in detail. As shown in FIGS. 4 to 6, the upper base 60 includes a discharge pipe 62 that is insertable into the front end 12*a* of the connection nozzle 12. The axis of the discharge pipe 62 is eccentric with respect to the axis B. The upper base 60 includes an air discharge part 64. The interior of the discharge pipe 62 and the air discharge part 64 are communicated with each other. The upper base 60 includes a pair of bosses 66 on an outer surface 60*b* thereof. Each boss 66 includes a screw hole (not shown in the drawings) that enables each screw 68 to be screwed therein. The pair of bosses 66 and the pair of bosses 50 of the lower base 42 are disposed in corresponding positions.

Next, the middle base 70 will be explained in detail. As shown in FIGS. 4 to 6, the middle base 70 partitions the air inflow part 48 of the lower base 42 and the air discharge part 64 of the upper base 60 therethrough. The middle base 70 includes a vertical wall 70*b* on the edge thereof. The vertical wall 70*b* includes a hook portion 70*a* capable of being hooked on an inner peripheral edge 42*c* of the lower base 42. The middle base 70 includes a through hole 72. The center of the through hole 72 is matched with the axis B. The middle base 70 includes an inner tube 72*a* on a back surface 70*c* (the lower base 42-side surface) thereof. The inner tube 72*a* has a larger diameter than the through hole 72 and is located about the axis B.

Figure 9:
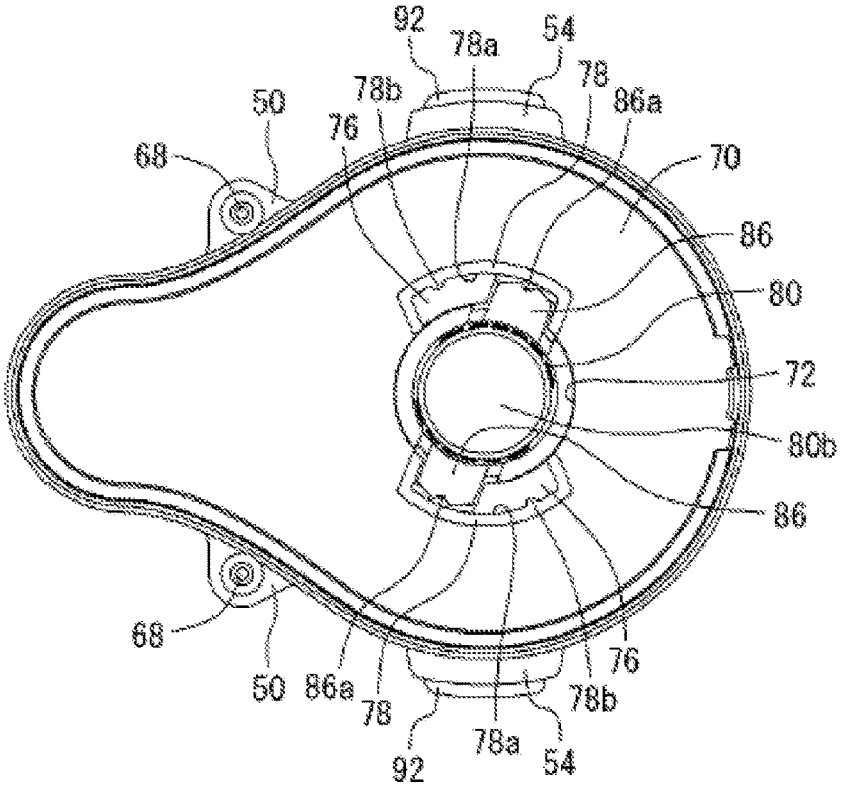
FIG. 9 is a schematic plan view of the cyclone unit from which an upper base is detached and in which assembling a core tube to a middle base is ongoing.

As shown in FIG. 4, the through hole 72 includes an opposed pair of cutout portions 74 on the edge thereof. Additionally, as shown in FIG. 9, the through hole 72 includes an opposed pair of hooked portions 76 on the edge thereof. Each of the pair of hooked portions 76 is disposed adjacently to each of the pair of cutout portions 74. The middle base 70 includes a pair of outer walls 78 on the front surface (the upper base 60-side surface) thereof. Each outer wall 78 guards each adjacent pair of the cutout portion 74 and the hooked portion 76 from the outer side. Each outer wall 78 includes a protrusion 78*b* on an inner surface 78*a* thereof such that the protrusion 78*b* is opposed to each hooked portion 76.

A core tube 80 is attachable to and detachable from the middle base 70. As shown in FIGS. 4 to 6, the core tube 80 is a tube member having a meshed shape, and includes a closed end 80*b* on a distal end 80*a* side thereof and includes an opened end on a base end 80*c* side thereof. The core tube 80 includes a plurality of minute holes 82 in an outer peripheral surface 80*d* thereof. The core tube 80 includes an opposed pair of restriction tabs 84 on the base end 80*c* thereof. The pair of restriction tabs 84 interferes with the edge of the through hole 72 of the middle base 70. Accordingly, when assembled to the through hole 72 of the middle base 70, the core tube 80 can be prevented from penetrating the through hole 72 (see FIG. 5).

The core tube 80 includes an opposed pair of hook tabs 86 on the base end 80*c* thereof. The pair of hook tabs 86 is insertable into the pair of cutout portions 74 of the middle base 70 (see FIG. 4). The pair of restriction tabs 84 and the pair of hook tabs 86 are disposed on the base end 80*c* of the core tube 80 at suitably set equal intervals in the circumferential direction so as not to overlap each other. Each hook tab 86 includes a cutout 86*a* on the outer periphery thereof. The cutout 86*a* enables the protrusion 78*b* on each outer wall 78 of the middle base 70 to be fitted thereto.

An example of a procedure to assemble the cyclone unit body 40 will be hereinafter explained. First, in the state shown in FIG. 4, the hook portion 70*a* of the middle base 70 is hooked on the inner peripheral edge 42*c* of the lower base 42. Next, the upper base 60 is put on the lower base 42. In other words, the middle base 70 is sandwiched between the lower base 42 and the upper base 60.

Next, each screw 68 is inserted into the screw hole 50*a* of each boss 50, and the inserted screw 68 is screwed into the screw hole of each boss 66. Thus, the both screws 68 are inserted into the both bosses 50 of the lower base 42 and the both bosses 66 of the upper base 60 (see FIG. 8). Next, the pair of hook tabs 86 of the core tube 80 is matched with the pair of cutout portions 74 of the middle base 70, and in this state, the core tube 80 is inserted into the through hole 72 of the middle base 70 until the pair of restriction tabs 84 of the core tube 80 interferes with the back surface 70*c* of the middle base 70 (see FIG. 9).

Next, the inserted core tube 80 is rotated (in the counterclockwise direction in FIG. 9) about the axis thereof (see FIG. 9). Accordingly, the pair of hook tabs 86 of the core tube 80 overlaps the pair of hooked portions 76 of the middle base 70, whereby the core tube 80 is prevented from coming off from the middle base 70 even in attempt to pull the core tube 80 away from the middle base 70.

Figure 10:
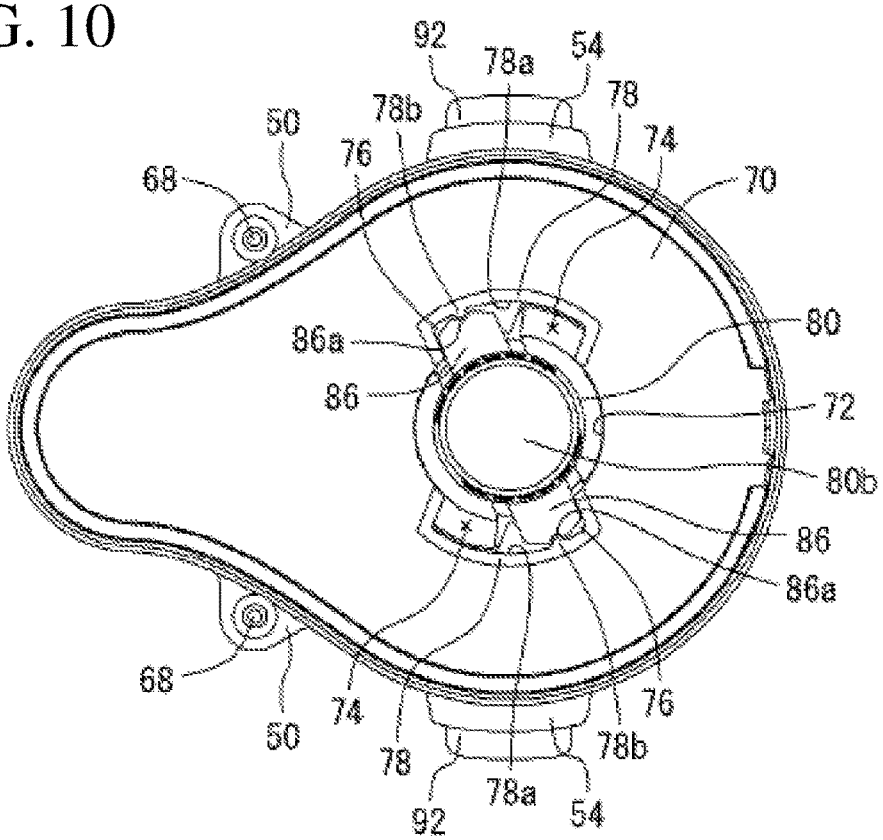
FIG. 10 is a schematic plan view of the cyclone unit from which the upper base is detached and in which assembling the core tube to the middle base is completed.
Figure 11:
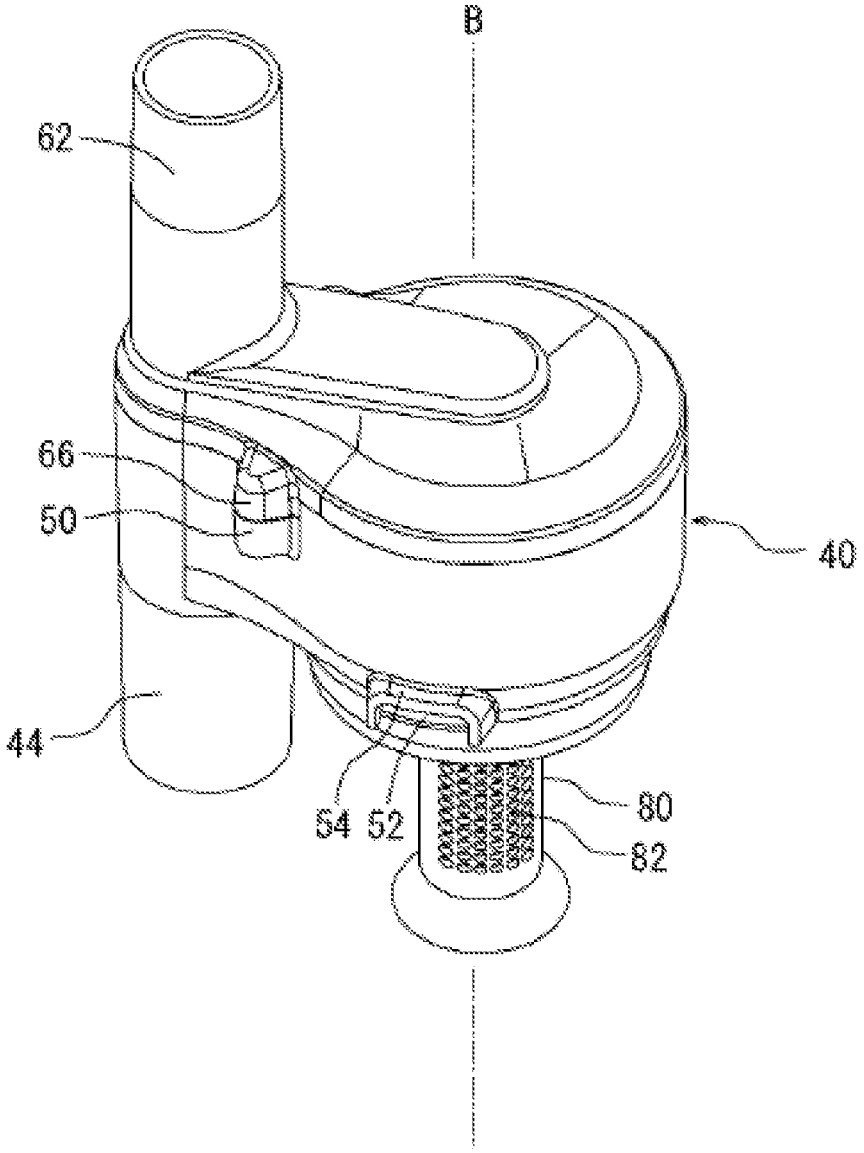
FIG. 11 is a view of the cyclone unit body for which assemblage is completed.

Then, the protrusions 78*b* of the pair of outer walls 78 of the middle base 70 are engaged with the cutouts 86*a* of the pair of hook tabs 86 of the rotated core tube 80, respectively (see FIG. 10). Thus, the core tube 80 is assembled to the middle base 70, and assemblage of the cyclone unit body 40 is completed (see FIG. 11). It should be noted that the core tube 80 assembled to the middle base 70 is capable of being disassembled therefrom by reversely performing the series of work. Simply put, when the core tube 80 is reversely rotated about the axis thereof with respect to the middle base 70 in this engaged state, the engaged state is released whereby the core tube 80 assembled to the middle base 70 is capable of being disassembled therefrom.

As shown in FIGS. 4 to 7, the dust box 90 is a closed-end tube member that the distal end side thereof is tapered. The dust box 90 includes the pair of engaging pawls 92 on an outer peripheral surface 90*a* thereof. Each engaging pawl 92 includes the hook 92*a* capable of being hooked on each hooked tab 52 of the lower base 42. Each engaging pawl 92 is rotatable about the axis of a pin 94 through a compression spring 96. Each engaging pawl 92 and each hooked tab 52 compose a lock part R. A direction in which each engaging pawl 92 is urged by the compression spring 96 is a direction in which the hook 92*a* of each engaging pawl 92 is hooked on each hooked tab 52 (in the counterclockwise direction in FIG. 7).

The hook 92*a* includes a slope 92*b* on the tip thereof. The slope 92*b* is opposed to the slope 52*a* of each hooked tab 52. It should be noted that each engaging pawl 92 is kept interfering with a flange 90*b* of the dust box 90 such that the slope 92*b* of the hook 92*a* thereof and the slope 52*a* of each hooked tab 52 are kept standby in inserting the distal end of the lower base 42 into the base end of the dust box 90 as described below.

The dust box 90 is capable of being assembled to the cyclone unit body 40. The procedure of this assemblage will be herein explained. First, the distal end of the lower base 42 is inserted into the base end of the dust box 90 in the state shown in FIG. 8. Accordingly, the slope 52*a* of each hooked tab 52 and the slope 92*b* of each engaging pawl 92 interfere with each other.

Because of this, each engaging pawl 92 is rotated about the axis of each pin 94 against the biasing force of each compression spring 96. By further inserting the distal end of the lower base 42 into the base end of the dust box 90, the hook 92*a* of each engaging pawl 92 rotated about the axis of each pin 94 gets over each hooked tab 52. Accordingly, the biasing force of each compression spring 96 returns each engaging pawl 92 to the state that each engaging pawl 92 interferes with the flange 90*b*, and also, the hook 92*a* of each engaging pawl 92 is hooked on each hooked tab 52 (see FIG. 7).

Consequently, each lock part R becomes locked, and the dust box 90 is assembled to the cyclone unit body 40 (see FIG. 3). In this way, the cyclone unit 2 is completed. As is obvious from FIG. 3 as well, the core tube 80 of the cyclone unit 2 is assembled to the middle base 70 so as to be located inside the dust box 90.

It should be noted that the hook 92*a* of each engaging pawl 92, hooked on each hooked tab 52, is released by inwardly pushing the base end side (the side opposite to the hook 92*a*) of each engaging pawl 92 against the biasing force of each compression spring 96 (by setting each engaging pawl 92 to a state depicted with imaginary line in FIG. 7) in the locked state of each lock part R. Accordingly, each lock part R becomes unlocked, whereby the distal end of the lower base 42 inserted into the base end of the dust box 90 is capable of being pulled therefrom. In this way, the dust box 90 assembled to the cyclone unit body 40 is capable of being disassembled therefrom.

Figure 2:
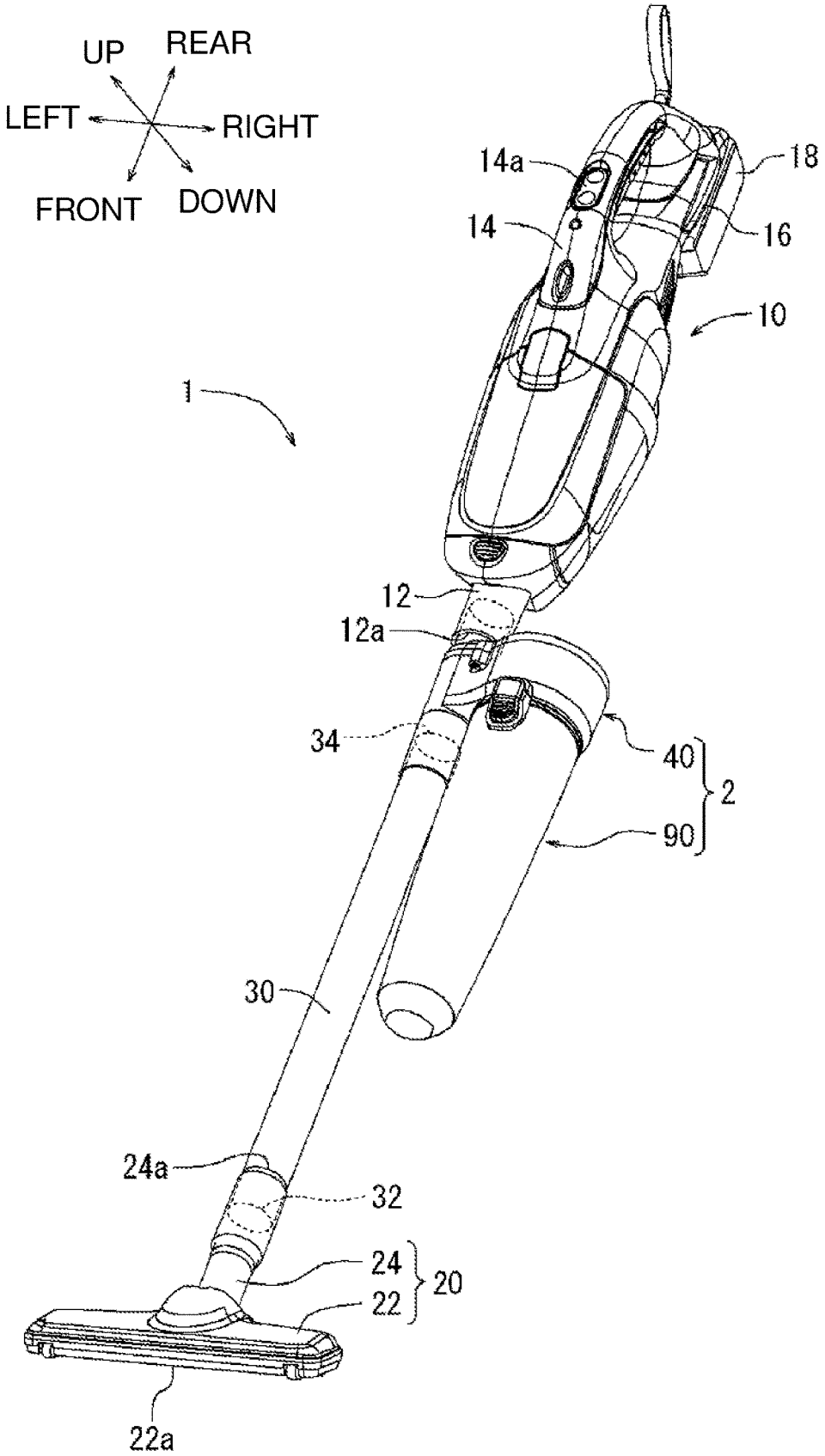
FIG. 2 is a perspective view of the handy cleaner equipped with a cyclone unit according to the embodiment.

The cyclone unit 2 is attached to the handy cleaner 1 (see FIGS. 2 and 5). Specifically, the rear end 34 of the extension pipe 30 is detached from the front end 12*a* of the connection nozzle 12. Then, the rear end 34 of the extension pipe 30 is inserted into the suction pipe 44 of the lower base 42, and furthermore, the discharge pipe 62 of the upper base 60 is inserted into the front end 12*a* of the connection nozzle 12.

Figure 12:
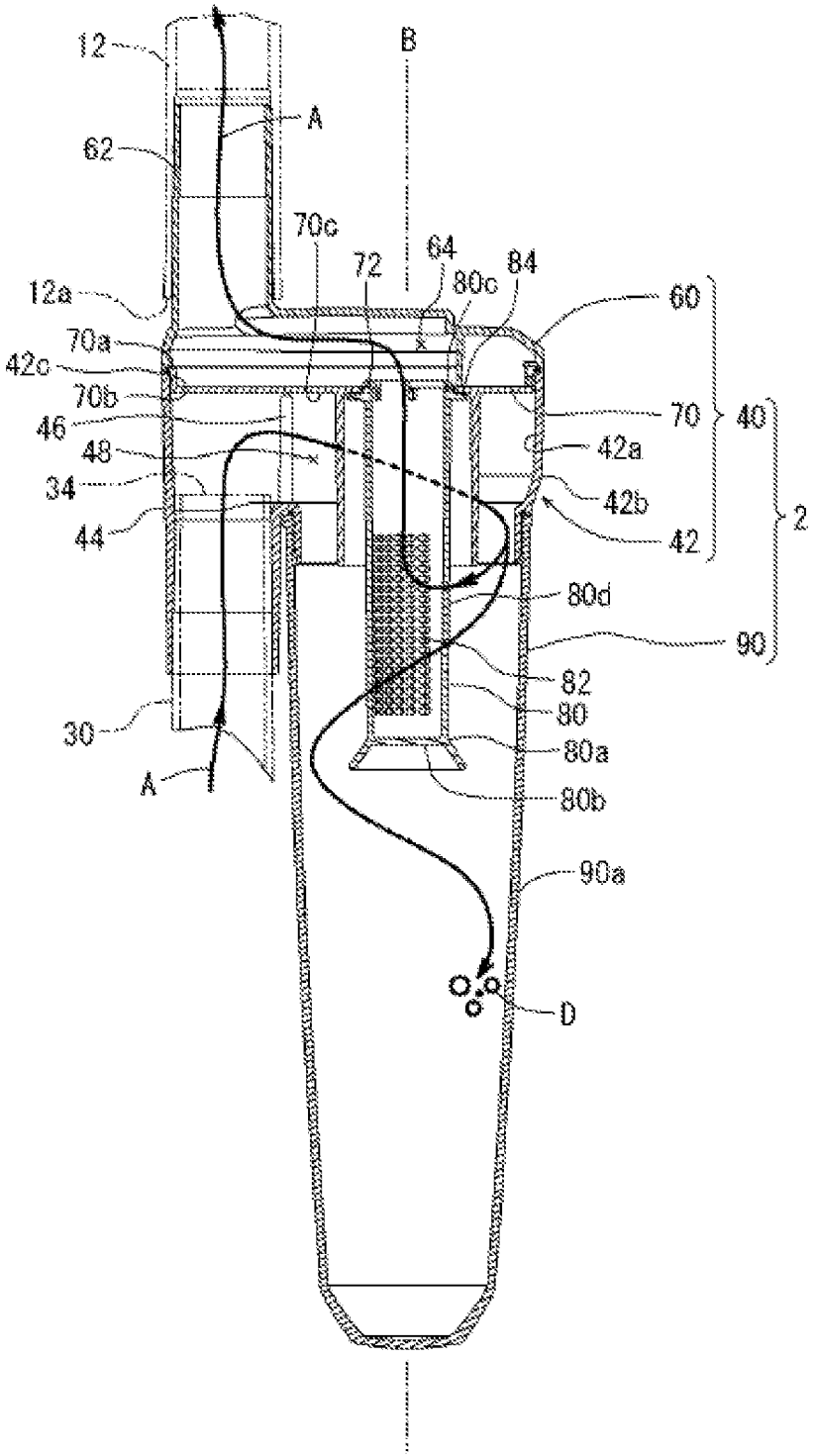
FIG. 12 is a diagram explaining airflow and dust-and-dirt flow in the cyclone unit according to the embodiment.

Next, the action of the handy cleaner 1 equipped with the cyclone unit 2 will be explained with reference to FIG. 12. When the turn-on operation is performed by the switch 14*a*, the electric motor is driven whereby the suction fan is rotated. Accordingly, the air A is sucked through the suction port 22*a* of the head housing 22, and the sucked air A is taken into the air inflow part 48 of the lower base 42 through the extension pipe 30 and the suction pipe 44.

Because of the rib 46, the taken air A flows in the form of swirl (vortex) along the inner surface 42*a* of the lower base 42. At this time, the dust and dirt D, contained in the air A, are separated from the air A by centrifugal force, go down along the inner peripheral surface of the dust box 90 by the weight thereof, and is collected in the dust box 90. In this way, the dust and dirt D are separated from the taken air A by the cyclone action.

The air A, from which the dust and dirt D are separated, passes through the minute holes 82 of the core tube 80, and is discharged to the connection nozzle 12 through the air discharge part 64 and the discharge pipe 62 in the upper base 60. At this time, because of passage of the air A through the minute holes 82 of the core tube 80, it is possible to collect even lightweight dust and dirt (e.g., hair) that are inseparable by the cyclone action. Thus, the cyclone unit 2 can be enhanced in dust collection performance.

The air A, discharged to the connection nozzle 12, is sucked therethrough. Because of this, even when the dust and dirt D remain in the sucked air A, the remaining dust and dirt D can be collected by the filter in the dust collection compartment of the cleaner body 10.

When the turn-off operation is performed for the switch 14*a*, the electric motor is stopped whereby rotation of the suction fan is also stopped. Accordingly, suction of the air A through the suction port 22*a* of the head housing 22 is stopped as well.

The dust and dirt D, collected inside the dust box 90, can be removed by detaching the dust box 90 from the cyclone unit body 40 while suction of the air A is being stopped. Additionally, even when the upper base 60 is kept assembled to the lower base 42, the core tube 80 is capable of being assembled to and disassembled from the middle base 70. In other words, the core tube 80 is attachable to and detachable from the middle base 70 while the upper base 60 is kept assembled to the lower base 42.

The cyclone unit 2 according to the present embodiment includes the meshed core tube 80, and hence, can collect even lightweight dust and dirt (e.g., hair) that are inseparable by the cyclone action. Because of this, the cyclone unit 2 can be enhanced in dust collection performance. Additionally, even when the upper base 60 is kept assembled to the lower base 42, the core tube 80 is configured to be attachable to and detachable from the middle base 70. Because of this, the core tube 80 is detachable from the cyclone unit body 40 without detaching the middle base 70 sandwiched between the lower base 42 and the upper base 60. Consequently, hair, tiny trash and so forth, clogging up the minute holes 82, can be removed from the detached core tube 80. Hence, the core tube 80 can be enhanced in workability in maintenance. Especially, some upper ones of the minute holes 82 are inserted into a lower part of the inner tube 72*a*, which is indicated as "inserted site C" in FIG. 5. Hence, this removal work is made quite easy.

Additionally, the core tube 80 is capable of being assembled to the middle base 70 by rotation thereof. Therefore, this assemblage can be made easy and convenient.

Moreover, the pair of hook tabs 86 of the core tube 80 overlap the pair of hooked portions 76 of the middle base 70 by rotation of the core tube 80 inserted into the through hole 72. Therefore, this assemblage can be made easy and convenient.

Furthermore, the protrusions 78*b* of the pair of outer walls 78 of the middle base 70 are engaged with the cutouts 86*a* of the pair of hook tabs 86 of the core tube 80, respectively. This makes it as difficult as possible for the core tube 80 to come off from the middle base 70.

Yet furthermore, the pair of hook tabs 86 and the pair of hooked portions 76 are disengaged from each other by reverse rotation of the core tube 80. Because of this, the core tube 80 assembled to the middle base 70 can be disassembled therefrom easily and conveniently.

The aforementioned content only relates to an illustrative embodiment of the present invention, and it should not be construed that the present invention is limited to the aforementioned content.

Figure 13:
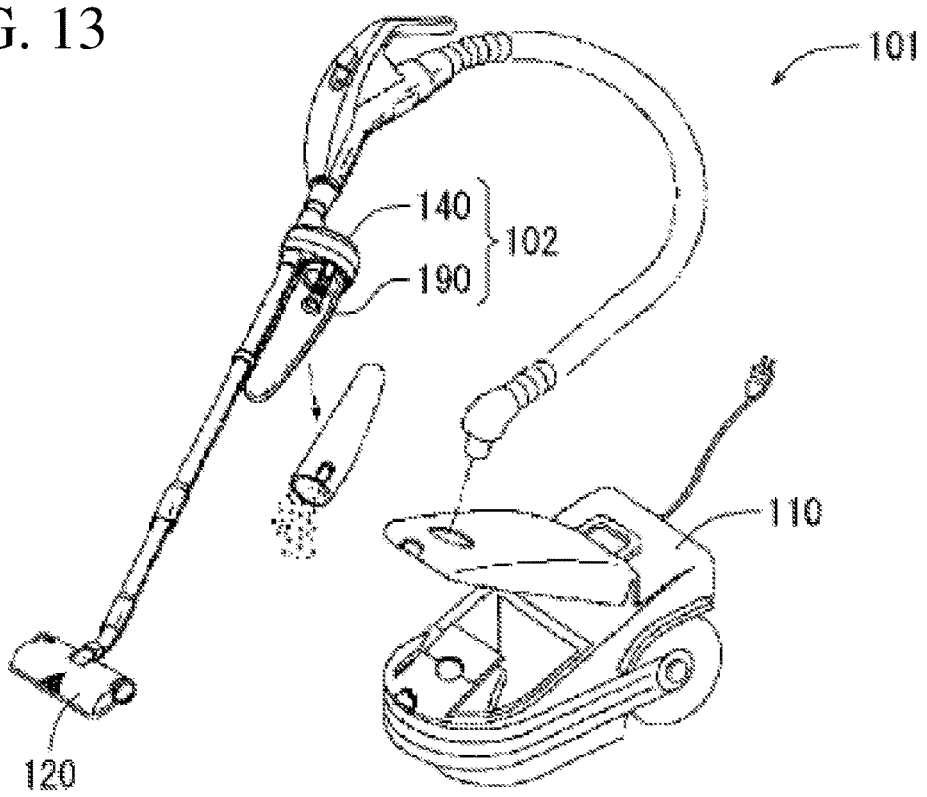
FIG. 13 is a perspective view of a conventional cleaner.
Figure 14:
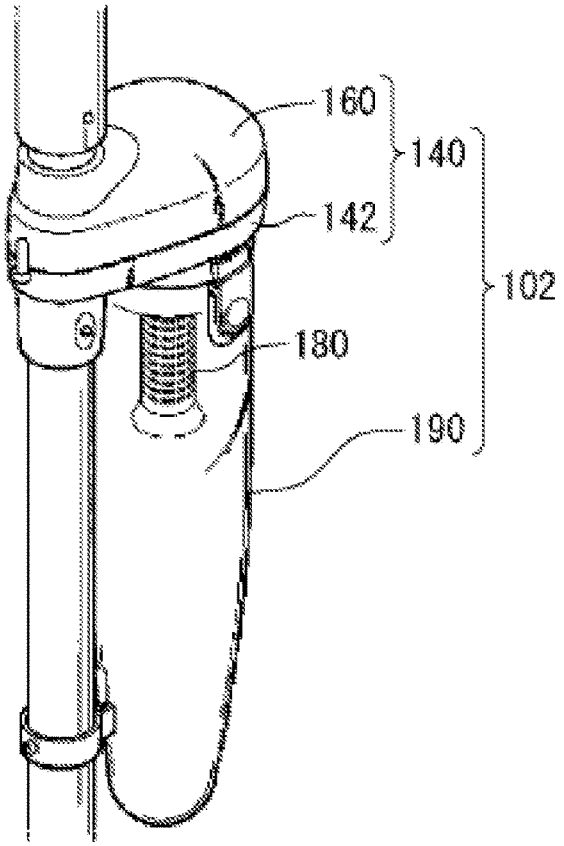
FIG. 14 is an enlarged view of a conventional cyclone unit.
Figure 15:
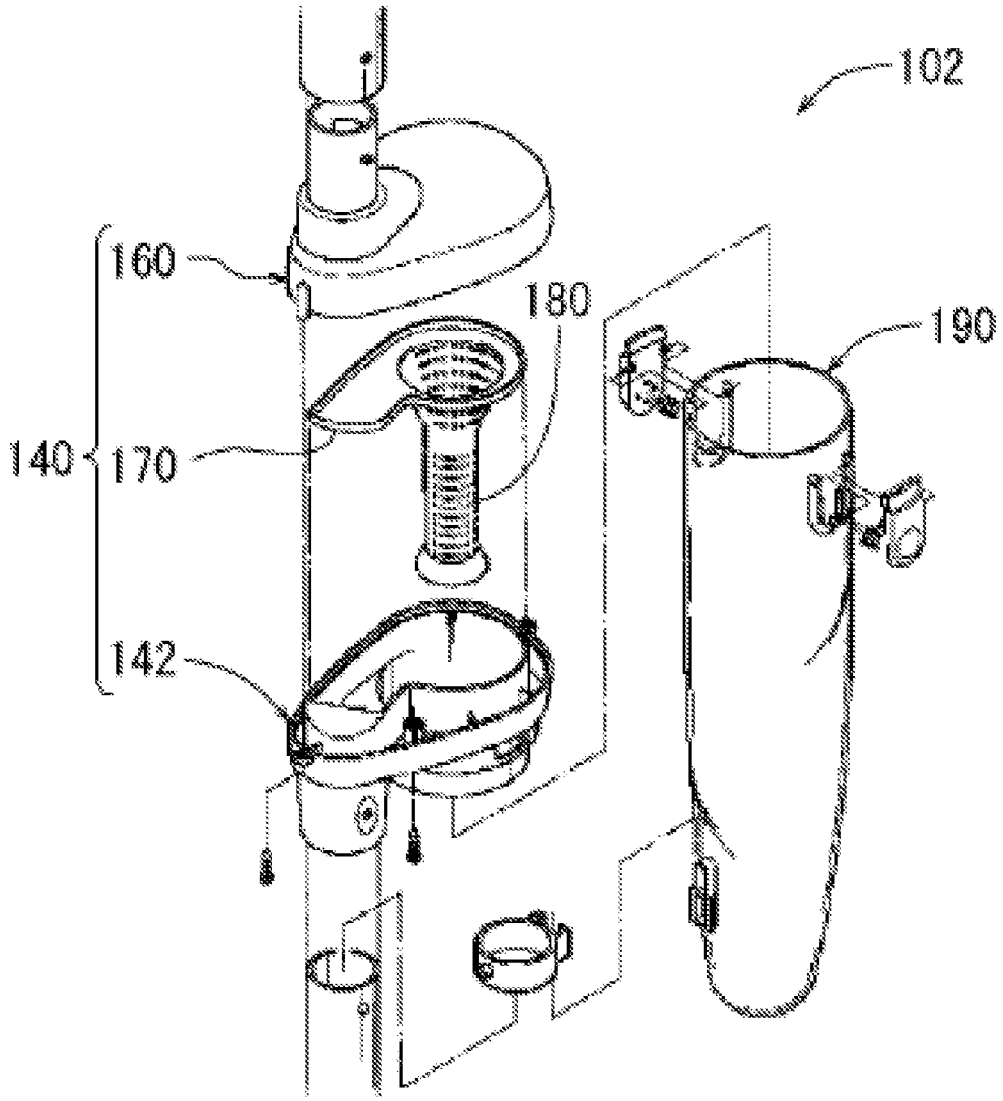
FIG. 15 is an exploded view of the conventional cyclone unit.

In the embodiment, "the hand cleaner 1" has been explained as an example of "the cleaner". However, "the cleaner" is not limited to this, and may be "a home use cleaner" as shown in FIG. 13.

Additionally, the cyclone unit body 40 according to the embodiment is composed of three members, i.e., the lower base 42, the upper base 60 and the middle base 70, and the core tube 80 is attachable to and detachable from the middle base 70. However, the construction of the cyclone unit body 40 is not limited to this. The cyclone unit body 40 may be composed of an arbitrary number of components (modifications). For example, the cyclone unit body 40 may be composed of a single member, and the core tube 80 may be attachable to and detachable from the cyclone unit body 40. Alternatively, the cyclone unit body 40 may be composed of two members, and the core tube 80 may be attachable to and detachable from either of the two members composing the cyclone unit body 40. Even in the modifications, it is possible to achieve advantageous effects similar to those achieved by the cyclone unit 2 of the embodiment.

REFERENCE SIGNS LIST

1 Handy cleaner
2 Cyclone unit
10 Cleaner body
12 Connection nozzle
12*a* Front end
14 Handle
14*a* Switch
16 Battery attachment part
18 Battery
20 Nozzle head
22 Head housing
22*a* Suction port
24 Connection pipe
24*a* Rear end
30 Extension pipe
32 Front end
34 Rear end
40 Cyclone unit body
42 Lower base
42*a* Inner surface
42*b* Outer surface
42*c* Edge
44 Suction pipe
46 Rib
48 Air inflow part
50 Boss
50*a* Screw hole

52 Hooked tab
52*a* Slope
54 Protection tab
56 Packing
60 Upper base
60*b* Outer surface
62 Discharge pipe
64 Air discharge part
66 Boss
68 Screw
70 Middle base
70*a* Hook portion
70*b* Vertical wall
70*c* Back surface
72 Through hole
72*a* Inner tube
74 Cutout portion
76 Hooked portion
78 Outer wall
78*a* Inner surface
78*b* Protrusion
80 Core tube
80*a* Distal end
80*b* Closed end
80*c* Base end
80*d* Outer peripheral surface
82 Minute holes
84 Restriction tab
86 Hook tab
86*a* Cutout
90 Dust box
90*a* Outer peripheral surface
90*b* Flange
92 Engaging pawl
92*a* Hook
92*b* Slope
94 Pin
96 Compression spring
101 Cleaner
102 Cyclone unit
110 Cleaner body
120 Suction tool
140 Cyclone unit body
142 Lower base
160 Upper base
170 Middle base
180 Core tube
190 Dust box
A Air
B Axis
C Inserted site
D Dust and dirt
R Lock part

What is claimed is:

1. A cyclone unit comprising:
a cyclone unit body including
a lower base,
an upper base assembled to the lower base, and
a middle base sandwiched between the lower base and the upper base, the middle base having a through hole;
an inner tube having a larger diameter than the through hole to surround the through hole, the inner tube extending downward from the middle base;
a dust box assembled to the cyclone unit body so as to collect dust and dirt; and
a core tube having a plurality of minute holes, the core tube being assembled to the middle base so as to be located inside the dust box, the core tube being arranged radially inside the inner tube, and the core tube being detachable from the middle base while the upper base is assembled to the lower base.

2. The cyclone unit according to claim 1, wherein the core tube is assemblable to the middle base by rotation thereof.

3. The cyclone unit according to claim 2, wherein
the middle base includes
a hooked portion formed on an edge of the through hole,
the core tube includes a hook tab, and
the hook tab overlaps the hooked portion by rotation of the core tube inserted into the through hole.

4. The cyclone unit according to claim 3, wherein the hook tab is engageable with the hooked portion.

5. The cyclone unit according to claim 4, wherein the hook tab and the hooked portion are disengaged from each other by reverse rotation of the core tube.

6. The cyclone unit according to claim 1, wherein the cyclone unit body is attachable to an end or an intermediate part of a coupling tube, the coupling tube coupling a cleaner body and a nozzle head therethrough, the cleaner body generating a suction force, the nozzle head sucking air by the suction force generated in the cleaner body.

7. The cyclone unit according to claim 1, wherein
the core tube has a center axis aligned with a center axis of the inner tube.

8. The cyclone unit according to claim 1, wherein
the plurality of minute holes are located in a lower portion of the core tube, and
upper minute holes of the plurality of minutes holes are located above a lower end of the inner tube.

9. The cyclone unit according to claim 7, wherein
the plurality of minute holes are located in a lower portion of the core tube, and
upper minute holes of the plurality of minutes holes are located above a lower end of the inner tube.

* * * * *